United States Patent [19]

Liotta

[11] 4,300,995

[45] Nov. 17, 1981

[54] OXYGEN-ALKYLATION OF CARBONOUS MATERIAL AND PRODUCTS THEREOF

[75] Inventor: Ronald Liotta, Clark, N.J.

[73] Assignee: Exxon Research & Engineering Co., Florham Park, N.J.

[21] Appl. No.: 164,239

[22] Filed: Jun. 30, 1980

[51] Int. Cl.[3] ..... C10G 1/00; C10B 57/04

[52] U.S. Cl. ..... 208/8 LE; 208/14; 208/46; 201/20

[58] Field of Search ..... 208/8 LE, 14, 46, 11 LE; 201/20

[56] References Cited

U.S. PATENT DOCUMENTS

| | | | |
|---|---|---|---|
| 2,378,762 | 6/1945 | Frey | 208/46 |
| 3,330,757 | 7/1967 | Bichard | 208/11 LE |
| 3,359,197 | 12/1967 | Masciantonio et al. | 208/14 |
| 3,376,212 | 4/1968 | Masciantonio et al. | 208/2 |
| 3,992,432 | 11/1976 | Napier et al. | 260/465.1 |
| 4,059,410 | 11/1977 | Schlosberg et al. | 44/1 R |
| 4,072,475 | 2/1978 | Schlosberg et al. | 44/1 R |
| 4,089,772 | 5/1978 | Gorbaty et al. | 208/8 LE |
| 4,092,235 | 5/1978 | Schlosberg et al. | 208/8 LE |

FOREIGN PATENT DOCUMENTS 851191 5/1977 Belgium .

OTHER PUBLICATIONS

Brändström et al., vol. 23, Acta Chem. Scand. p. 2202 (1969).

Wagenknecht et al., vol. 2, Synthetic Communications, pp. 215–219 (1972).

McKillop et al., vol. 30, Tetrahedron, pp. 1379–1382 (1974).

Bashall et al., Tetrahedron Letters, pp. 3489–3490 (1975).

German "Off." DT-2634419.

Blom et al., vol. 36, Fuel, pp. 135–153 (1957).

Yohe et al., vol. 69, Journal of American Chem. Society, pp. 2644–2648, 1947.

Sternberg et al. vol. 53, Fuel, pp. 172–175 (1974).

Heathcoat et al., J. of the Chem. Society, p. 2839 ff (1932).

Kroger et al., vol. 18, Erdöl und Kohle Erdgas Petrochemie, pp. 368–372, 1965.

Sokolova et al., vol. 1, Trudy Inst. Nefti, Akad. Nauk SSSR, pp. 277–284, 1950.

Fugassi et al, Am. Chem. Soc., Div. of Gas Fuel Chem. Preprints, pp. 125–131, 1958.

Hodek et al., vol. 52, Fuel, pp. 220–225 (1973).

Olleman vol. 24, Anyl. Chem, pp. 1425–1439 (1952).

Lahiri et al., vol. 36, Fuel, pp. 254–256 (1957).

Zabavin, Bulletin of Academy of Science, USSR Classe Sci. Tech., No. 8, pp. 35–49 (1943).

Danetskaya, Gigiena i Sanit., pp. 26–31 (1952).

Vol. 20 J. of Indian Chem. Soc., Ind. and News Ed., pp. 91–94 (1957).

*Primary Examiner*—Delbert E. Gantz
*Assistant Examiner*—William G. Wright
*Attorney, Agent, or Firm*—Henry E. Naylor

[57] ABSTRACT

Disclosed is a method for improving the properties of carbonous materials and products thereof by oxygen-alkylation. The carbonous material is treated with a quaternary base then heated to temperatures from about 100° C. to 400° C.

24 Claims, No Drawings

OXYGEN-ALKYLATION OF CARBONOUS MATERIAL AND PRODUCTS THEREOF

BACKGROUND OF THE INVENTION

This invention is directed to improving properties of carbonous materials such as coal and oil shale and, in particular, to improving yields and physical characteristics of products derived therefrom.

Much work has been done in recent years to make useful liquids and gases from carbonous materials such as coal and oil shale. Various types of liquefaction processes have been developed such as solvent refining, direct hydrogenation with or without a catalyst, catalytic and non-catalytic hydrogenation in the presence of a non-donor solvent, and catalytic and non-catalytic liquefaction by the donor solvent method. Exemplary of a hydrogen donor solvent liquefaction process is that disclosed in U.S. Pat. No. 3,617,513.

In an effort to increase liquefaction yields, a number of ancillary processes have been developed. Such processes include the pretreatment of coal prior to a liquefaction process or post-treatment of products derived from a liquefaction process, i.e., liquefaction distillates, coal liquids, and coal bottoms. Exemplary of pretreatment processes in U.S. Pat. No. 4,092,235, which discloses acid-catalyzed Friedel-Crafts carbon-alkylation and carbon-acylation of coal to increase the yield of products from coal liquefaction. The introduction of aliphatic hydrocarbon radicals or acyl radicals, including carbon monoxide, into the coal structure, is believed to permit a greater quantity of the coal to undergo liquefaction at suitable liquefaction conditions. The alkylation and acylation reactions, which may be conducted in the presence or absence of added or extraneous catalysts, take place at carbon sites.

Other processes have also been proposed to increase liquefaction yields and to improve the properties of products therefrom. For example, copending U.S. application Ser. No. 62,809, filed Aug. 1, 1979, now U.S. Pat. No. 4,259,084, and Ser. Nos. 69,059; filed Aug. 23, 1979, now U.S. Pat. No. 4,259,167; 69,061, filed Aug. 23, 1979, now U.S. Pat. No. 4,259,072; 69,064, filed Aug. 23, 1979; and 69,066, filed Aug. 23, 1979, now U.S. Pat. No. 4,259,173, disclose processes for treating the weakly acidic protons of coal and coal products by oxygen-alkylation and oxygen-acylation employing a phase transfer reagent and an alkylating or acylating agent.

While these processes have met with varying degrees of success, there is still a need in the art to develop more efficient methods for improving liquefaction yields and improving the properties of coal products.

SUMMARY OF THE INVENTION

In accordance with the present invention there is provided a process for improving the properties of carbonous materials such as coal and oil shale and enhancing the yield and quality of products derived therefrom, which process comprises: (a) treating the carbonous material with one or more quaternary bases; and (b) heating the treated material to elevated temperatures from about 100° C. to about 300° C. The quaternary ammonium base can be represented by the formula $R_3R'MOR''$ where each R is the same or different group selected from the $C_1$ to about $C_{20}$ alkyl, aryl, acyl, arylalkyl, alkylaryl, ether and ester groups, sulfide, amine and heteroatoms of silicon, selenium or a metal selected from groups I or II of the Periodic Table of the Elements. R′ is a $C_1$ to $C_4$ alkyl group. M is selected from Group VA of the Periodic Table of the Elements. R″ is hydrogen, or a $C_1$ to about $C_{20}$, alkyl, aryl, arylalkyl or alkylaryl group. In each composition, R may be the same or different group provided the boiling point of the resulting tertiary or trisubstituted amine $NR_3$ (a side product of the present process) is lower than that of the carbonous material from which it is separated.

In one preferred embodiment of the present invention, coal is first treated according to the present invention, then subjected to a liquefaction process.

DETAILED DESCRIPTION OF THE INVENTION

Carbonous materials on which the practice of the present invention is suitable include those carbon-containing materials having acidic functionalities and having a pka of less than or equal to 22. By the process of the present invention, acidic functionalities of the carbonous material are altered by deprotonation followed by alkylation. Examples of such acidic functionality include the more acidic groups such as carboxylic, hydroxyl, mercaptan and phenolic, as well as the weaker acidic groups such as amines. In the case of coal, or a product thereof, the most abundant acidic functionality that is altered by the practice of this invention is the phenolic functionality, especially when higher ranking coals and/or products thereof are employed.

Preferred carbonous materials on which the present invention can be employed include coal, peat, oil shale and organic products thereof, as well as heavy oils (boiling point of 540° C. or greater), and vacuum and gas oil petroleum residuals. Preferred products of coal, peat and oil shale on which the present invention is particularly suitable are those products resulting from liquifaction and gasification processes and may include liquids of various viscosities.

Non-limiting examples of coals suitable for treatment herein include anthracite, bituminous, subbituminous and lignite. Typically, the aforementioned coals have the following character; a carbon content ranging from about 55 to 93 wt. %, a hydrogen content ranging from about 2.2 to 6.2 wt. %, an oxygen content ranging from about 3 to 23 wt. % (DMMF—dry-mineral-matter-free basis), and an H/C ratio ranging from about 0.3 to 1.1.

Quaternary bases suitable for use herein are one or more of those bases represented by the formula: $R_3R'MOR''$ where each R is the same or different group selected from the $C_1$ to about $C_{20}$ alkyl, aryl, acyl, arylalkyl, alkylaryl, ether, ester, sulfide and amine, as well as silicon, selenium and a metal selected from Groups I and II of the Periodic Table of the Elements. By Periodic Table of the Elements, we mean the table which is represented on the inside covers of the Handbook of Chemistry and Physics, 55th Edition, by CRC Press. Preferably R is a $C_1$ to $C_{20}$ alkyl, aryl, acyl, arylalkyl, or alkylaryl group; more preferably R is an aryl or a $C_1$ to $C_6$ alkyl group; most preferably R is a $C_1$ to $C_4$ alkyl group. R′ is a $C_1$ to $C_4$ alkyl group, preferably a methyl group. M is selected from Group VA of the Periodic Table of the Elements, preferably nitrogen and phosphorus, more preferably nitrogen. R″ is hydrogen, a $C_1$ to $C_{20}$, preferably a $C_1$ to $C_{10}$, alkyl, aryl, arylalkyl or alkylaryl; more preferably R″ is hydrogen. It is of course understood that an aryl group itself must contain at least six carbon atoms. In each composition R may be the same or different group provided the boiling point of the resulting tertiary or trisubstituted amine, $NR_3$ (a side-product of the present process) is less than that of the carbonous material from which it is separated, preferably by conventional distillation methods. For example, it is preferred that the total number of carbon atoms of the tertiary amine be less than about 20, otherwise the boiling point of the amine approaches that of a carbonous material, such as coal liquids, and cannot be easily separated by conventional distillation techniques.

Non-limiting examples of such quaternary bases suitable for use herein include tetramethylammonium hydroxide and alkoxide, tetraethylammonium hydroxide and alkoxide, tetrapropylammonium hydroxide and alkoxide, tetrabutylammonium hydroxide and alkoxide, tetrapentylammonium hydroxide and alkoxide, tetrahexylammonium hydroxide and alkoxide, benzylhexadecyldimethyl ammonium hydroxide and alkoxide, as well as mixtures thereof and their phosphonium counterpart. Preferred are the ammonium hydroxides and $C_1$ to $C_4$ alkoxides, more preferred are the ammonium hydroxides and most preferred is tetramethylammonium hydroxide.

Although not wishing to be limited by theory, the following reactions are depicted to merely illustrate the chemical transformations which are believed to take place on functionalities such as phenolic and carboxylic functionalities of the carbonous material when alkylated in accordance with the present invention:

$$CA{-}OH + R_3R'MOR'' \rightarrow CA{-}O^-M^+R'R_3 + HOR''$$

$$CA{-}O^-M^+R'R_3 \xrightarrow{100°-300° C} CA{-}O{-}R' + MR_3$$

where CA—OH represents that portion of a carbonous material containing a particular representative phenolic or carboxylic entity, N is nitrogen, and R, R′ and R″ are groups as previously defined herein.

As previously discussed, it is preferred that the quaternary bases be chosen so that the boiling point of the resulting tertiary Group VA compound, side product $MR_3$, be as low as possible to insure ease in separation from the treated carbonous materials by conventional separation techniques; for example, if the carbonous material being treated is a coal liquid, the separation of the tertiary compound from the coal liquid can be accomplished by conventional distillation. If the boiling point of the tertiary compound is so high that a normal distillation procedure would have a deteriorating effect on the coal liquid, the distillation can be performed under reduced pressures. The precise conditions for such separation of course can be easily determined by one having ordinary skill in the art and does not itself constitute the present invention.

In chosing the alkyl group R′, two factors should be considered. The first factor is the addition of relatively long carbon chains to the carbonous material, thereby rendering the carbonous material, especially a coal liquid, more petroleum-like. That is, the carbonous material will become more soluble in common organic solvents and more compatible with petroleum liquids. The second factor is that the addition of relatively short carbon chains would render the carbonous material more volatile and more economically valuable while still improving its solubility and to a degree, its compatibility properties. Therefore, a compromise must be made in the chain length of the added alkyl group, depending on the desired balance of properties of the resulting alkylated material and the economics of the particular system.

In reaction (1) of the third paragraph before, the carbonous material is contacted with the quaternary base for a time sufficient to enable the complete reaction of the quaternary base with the acidic protons of the carbonous material, generally this time is instantaneous to up to about 10 minutes. Although ambient temperature (25° C.) is sufficient, the reaction can be carried out over a range from ambient temperature to about the rearrangement temperature of the mixture. Increased temperature will, of course, increase the reaction rate of the proton transfer as well as the alkyl group migration. Furthermore, the reaction is conveniently carried out at atmospheric pressure, although reduced pressure, as well as elevated temperatures, can be employed to increase the reaction rate.

The quaternary base as used herein is in solution form and can be prepared by dissolving the corresponding quaternary salt in a solvent selected to give the desired base. Non-limiting examples of such solvents suitable for use herein include water, $C_1$ to $C_{20}$ aliphatic alcohols, phenol, etc. For example, if the desired base of a particular quaternary salt is the corresponding hydroxide, then the quaternary salt is dissolved in water. Furthermore, if the desired base is a methoxide, then methanol is used as the solvent. In other words, the complementary alcohol to the alkoxide etc. is used to dissolve the quaternary salt. It will be noted that only a stoichiometric amount of solvent is needed to convert the quaternary salt to the corresponding base; preferably an excess amount of such solvent is employed so that in actuality it functions as a solvent.

It is also within the scope of this invention to use a co-solvent, which may act to increase the reaction rate. Non-limiting examples of co-solvents suitable for use herein include tetrahydrofuran, benzene, toluene, etc.

After the carbonous material is treated with the quaternary base and the resulting trisubstituted compound separated therefrom, the treated carbonous material is heated to a temperature from about 100° C. to about 300° C., preferably from about 150° C. to about 250° C. to effect rearrangement of the alkyl group R′ to form the O-alkylated carbonous material.

Quaternary ammonium base can be regenerated by conventional techniques and recycled in the process of the invention. One technique which can be used is alkylating the trisubstituted compound ($MR_3$) with an alkylating agent to form the quaternary ammonium salt $R_4M^+X^-$. This salt can then be converted to the corresponding quaternary hydroxide by treatment with silver oxide. Other conventional techniques include electrolysis or an ion-exchange method in which the quaternary salt solution is passed through an ion-exchange column filled with a highly basic anion-exchange resin, preferably in —OH form. Such resins are generally known in the art and the selection of any particular resin, as well as the reaction conditions, can be determined by routine experimentation by one having ordinary skill in the art.

Alkylating agents suitable for use in regenerating the quaternary base are those represented by the formula RX where R is one or more $C_1$ to $C_{20}$ alkyl groups and X is a leaving group selected from the group consisting of halide, sulfate, bisulfite, acetate, and stearate, wherein X is attached to a primary or secondary carbon atom. When the alkylating agent is a halide, the halide is selected from the group consisting of chlorine, bromine, and iodine. More preferred is when the alkylating agent is a methyl halide or dimethyl sulfate, most preferred is dimethyl sulfate.

Once the reagents, and solvents if any, are separated from the alkylated material, infrared analysis may be used to demonstrate the extent to which the acidic sites of the carbonous material have been alkylated. If the added alkyl group is IR-active, then the appearance of the appropriate infrared frequency is observed. Other well-known analytical methods may also be employed if desired. The ultimate analysis of the percent C, H, N, S and O before and after treatment is compared and should be consistent with the expected change owing to the added alkyl substituent. For example, the increase in the H/C ratio of O-methylated coal liquid derived from Illinois No. 6 coal indicates that 3.5 methyl groups per 100 carbon atoms are added to the coal liquid. The H/C ratio in the untreated coal liquid derived from Illinois No. 6 coal is 1.004 and H/C ratio after O-methylation by the process of the invention is 1.037. Also, the treated coal liquids become more soluble in common organic solvents. For example, the solubility (20° C.) of O-methylated coal liquids in cyclohexane increases to 63% from 11% for untreated coal liquids.

In the case of coal bottoms from Illinois No. 6 coal, 3.5 methyl groups per 100 carbon atoms was added to the coal bottoms by the present invention. Further, the H/C ratio in the untreated coal bottoms from Illinois No. 6 coal was 0.754 and the H/C ratio after methylation by the process of the invention was 0.790.

In the case of solid coal, there was an increase of 4.5 methyl groups per 100 carbon atoms for Illinois No. 6 coal. The H/C ratio of the untreated coal was 0.84 as opposed to 0.89 after methylation.

In Thermogravimetric analysis of the methylated coal showed a significant increase in volatile organic content over the untreated coal (38% versus 32%). For coal bottoms the increase in volatile organic content was 48% for treated coal bottoms versus 38% for untreated bottoms.

Furthermore, solvent extraction of coal and coal bottoms is greatly increased after it is O-alkylated. For example, Illinois 6 coal and bottoms thereof, become more soluble in common organic solvents after they are oxygen-methylated, as shown in Table I below.

TABLE I

MAXIMUM SOLUBILITY (at 1 atm and 25° C.)

| | Toluene | Tetrahydro furan | Pyridine |
|---|---|---|---|
| Illinois #6 Coal O-Methylated | 3% | 17% | 27% |
| Illinois #6 Coal | 7% | 22% | 34% |
| Illinois #6 Coal Bottoms | 22% | 60% | — |
| O-Methylated Illinois #6 Coal Bottoms | 95% | 95% | — |

Liquids which are derived by solvent extraction of carbonous materials treated in accordance with this invention evidence both improved quality as well as increased quantity over liquids derived from non-treated material. The soluble fractions of the O-alkylated carbonous materials will be found to have a higher H/C ratio than the soluble fractions of untreated carbonous materials.

It will also be noted that the caking properties of coal can be improved by the practice of the present invention; for example, lower rank coals having little or no caking properties will manifest considerably improved caking properties upon pyrolysis of coal if the coal is first treated according to the present invention. Further, as a consequence of employing the process of the invention, pyrolysis of coal so treated will yield liquids and gasses having improved stability and compatibility with petroleum products, as well as having a higher hydrogen content over the untreated coal. Blends of petroleum liquids, and coal liquids treated in accordance with the invention, evidence increased stability.

Subsequent to O-alkylation, the product can be subjected to liquefaction. The products of the liquefaction process are usually light gases, liquid products, and a bottoms fraction. It is contemplated that all or a portion of the remaining solid residue may be recycled from the liquefaction zone to the alkylation zone. Separation of the solids material can be carried out by any known means, such as filtration, vacuum distillation, centrifugation, hydroclones, etc., and preferably by vacuum distillation.

Various types of liquefaction methods may be employed, such as solvent refining, as exemplified by the PAMCO process which was developed by the Pittsburgh and Midway Coal Company, direct hydrogenation with or without a catalyst, catalytic or noncatalytic hydrogenation in the presence of a nondonor solvent, catalytic or noncatalytic liquefaction by a hydrogen donor solvent method, the latter being preferred particularly in the presence of hydrogen during the liquefaction step. A hydrogen donor solvent liquefaction process suitable for use herein is described in U.S. Pat. No. 3,617,513 and incorporated herein by reference.

As used herein, liquefaction means the molecular weight degradation of coal as distinguished from mere solvent extraction where essentially no molecular weight degradation takes place, e.g., extraction with solvents such as benzene, pyridine, or tetrahydrofuran at room temperature or temperatures ranging up to the boiling point of the extractive solvent. Thus, substantial chemical reaction does not occur until the temperatures are raised above about 150° C., preferably above about 200° C. Liquefaction, as opposed to solvent extraction, is a more severe operation, maximizes light liquid yields, and involves substantial chemical reaction of the coal. Solvent extraction tends to maximize heavier liquid yields, e.g., fuel oil and higher boiling constituents while involving little or no covalent bond cleavages due to the temperatures involved, e.g., less than 200° C., preferably less than 150° C., still more preferably less than 115° C. Additionally, maximizing light liquid yields allows for separation of the bottoms by distillation, e.g., vacuum distillation, rather than by filtration, which is used for solvent refined coals.

Briefly, hydrogen donor solvent liquefaction utilizes a hydrogen donation solvent which is comprised of one or more donor compounds such as indane, $C_{10}$–$C_{12}$ tetralins, $C_{12}$–$C_{13}$ acenaphthenes, di- tetra- and octahydroanthracenes, tetrahydroacenaphthene, 1,2,3,4-tetrahydroquinoline, 1,2,3,4-tetrahydroisoquinoline, piperidine, pyrrolidine, 1,2,3,4-tetrahydrocarbazole as well as other suitable derivatives of partially saturated hydroaromatic compounds. The donor solvent can be the product of the coal liquefaction process and can be a wide boiling hydrocarbon fraction; for example, boiling in the range of about 300° to 900° F., preferably about 375° F. to 800° F. The boiling range is not critical except insofar as a substantial portion of the hydrogen donor molecules are retained in the liquid phase under liquefaction conditions. Preferably, the solvent contains at least about 30 wt. %, more preferably about 50 wt. %, based on solvent, of compounds which are known hydrogen donors under liquefaction conditions. Thus, the solvent is normally comprised of donor and nondonor compounds.

Since the donor solvent can be obtained by hydrogenating coal liquids derived from liquefaction, for example, then the composition of the hydrogen donor solvent will vary depending upon the source of the coal feed, the liquefaction system and its operating conditions and solvent hydrogenation conditions. Further details of a hydrogenated liquefaction recycle stream are discussed in U.S. Pat. No. 3,617,513.

In hydrogen donor solvent liquefaction, coal is slurried in the hydrogen donor solvent and passed to a liquefaction zone wherein the convertible portion of the coal is allowed to disperse or react. O-alkylation of the coal by process of this invention is believed to render more of the coal convertible as compared to untreated coal.

The solvent/coal ratio, when about 50 wt. % of the solvent is hydrogen donor-type compounds, can range from about 0.5:1 to 4:1, preferably about 1:1 to 2:1. Preferably, the donor solvent contains at least about 25% hydrogen donor compounds, more preferably at least about 33% hydrogen donor compounds. Operating conditions can vary widely, that is, temperatures of about 600° to 1000° F., preferably about 750° to 900° F.; pressures of about 300 to 3000 psig, preferably about 1000 to 2500 psig; residence times of about 5 minutes to 200 minutes; and molecular hydrogen input of about 0 to 4 wt. % (based on DMMF coal charged to the liquefaction zone in the slurry). The primary products removed from the liquefaction zone are light gases, liquid products and a slurry of unconverted coal and ash in the heavy oil. Since the liquid state products contain the donor solvent in a hydrogen depleted form, the liquid can be fractionated to recover an appropriate boiling range fraction which can then be hydrogenated and returned to the liquefaction zone as recycled, hydrogenated donor solvent.

Recycle solvent, preferably boiling in the range of about 350° to 800° F., separated from the liquid product of the liquefaction zone, can be hydrogenated with hydrogen in the presence of a suitable hydrogenation catalyst. Hydrogenation temperatures can range from about 650° to 850° F., pressures can range from about 650 to 2000 psig and space velocities of 1 to 6 weights of liquid per hour per weight of catalyst can be employed. A variety of hydrogenation catalysts can be employed such as those containing components from Group VIB and Group VIII, e.g., cobalt molybdate on a suitable support, such as alumina, silica, titania, etc. The hydrogenated product is then fractionated to the desired boiling range and recycled to the liquefaction zone or slurried with the coal prior to the liquefaction zone.

The coal liquid derived from liquefaction may be further processed, employing conventional refining techniques. The coal liquids will have a lower viscosity and boiling range and will be produced in higher yield and will be more compatible with petroleum liquids than coal liquids produced without the O-alkylation process of the present invention. If so desired, the coal liquid may be alkylated in a separate zone, employing the alkylating procedures described above. The same ranges of conditions, reagents, concentrations and the like are advantageously employed to produce a coal liquid more compatible with petroleum liquids. When coal liquids are O-alkylated herein it is preferred that the temperatures employed be from about 100° C. to the boiling point of the coal liquid.

Light gases, such as CO, $CO_2$, $H_2S$ and light hydrocarbons generated by the liquefaction process may be collected and separated. Light hydrocarbon gases may be halogenated, such as by a free radical process, to form RX compounds, which may be recycled, thereby providing at least a partial source of alkylating agent for the regeneration of the quaternary base.

Coal bottoms from the liquefaction zone may be recycled to the alkylation zone. Alternatively, coal bottoms may be treated in a separate alkylation zone and the recombined with the feed to the liquefaction zone. Even if not further processed in this particular manner, the coal bottoms are more compatible with petroleum liquids and are more soluble in common organic solvents than untreated coal bottoms. When coal bottoms are O-alkylated according to the present invention they are O-alkylated at a temperature from about 100° C. to about 300° C.

The following examples serve to more fully described the manner of making and using the above-described invention, as well as to set forth the best modes contemplated for carrying out various aspects of the invention. It is understood that these examples in no way serve to limit the true scope of this invention, but rather, are presented for illustrative purposes.

EXAMPLE 1

Three grams of coal liquefaction bottoms derived from Wyodak coal was mixed with 8 cc of 2 molar(M) tetrabutylammonium hydroxide in methanol. The resulting quaternary ammonium organic salt was heated to 250° C. A thermal rearrangement took place which produced O-butylated coal bottoms and tributylamine.

EXAMPLE 2

Three grams of coal liquid derived from Illinois No. 6 coal and having a boiling range of 340° to 565° C. was mixed with 8 cc of 2 M tetrabutylammonium hydroxide in methanol. The resulting quaternary ammonium organic salt was then heated to 250° C. A thermal rearrangement took place which produced an O-butylated coal liquid and tributylamine.

Although not wishing to be limited hereby it is believed that the reactions and rearrangements of examples 1 and 2 can be represented by the following:

$$\underset{\text{coal liq. or bottoms}}{RO{-}H} + \underset{\text{Base}}{(C_4H_9)_4NOH} \longrightarrow \underset{\text{Organic Salt}}{RON(C_4H_9)_4} + H_2O$$

$$RON(C_4H_9)_4 \xrightarrow[250^\circ\,C.]{\Delta} \underset{\text{O-butylated material}}{ROC_4H_9} + \underset{\text{Tributylamine}}{(C_4H_9)_3N}$$

EXAMPLE 3

Three grams of coal liquefaction bottoms derived from Wyodak coal was mixed with 8 cc of 2 M tetramethylammonium hydroxide in methanol. The resulting quaternary ammonium organic salt was heated to 250° C. A thermal rearrangement took place which produced O-methylated coal bottoms and trimethylamine.

EXAMPLE 4

Three grams of coal liquids derived from Illinois No. 6 coal and having a boiling range of 340° to 565° C. was mixed with 8 cc of 2 M tetramethylammonium hydroxide in methanol. The resulting quaternary ammonium organic salt was heated to 250° C. A thermal rearrangement took place which produced an O-methylated coal liquid and trimethylamine.

Confirmation that chemical reaction took place in examples 1 to 4 was largely spectroscopic. The $^{13}C$-NMR spectra of the O-alkylated coal liquids and bottoms revealed the incorporation of the added alkyl group. The presence of a signal at 55 PPM in the case of the O-methylated materials and at 68 PPM for the O-butylated materials served as a diagnostic indication that the chemistry proceeded as illustrated by the above equations.

EXAMPLE 5

Fifty grams of Illinois No. 6 bituminous coal was mixed with 340 grams of 40 wt. % tetrabutylammonium hydroxide in water solution. To this was added 330 cc of tetrahydrofuran (THF) and briefly agitated. The volatile liquids (substantially all the THF and most of the water) were removed by vacuum distillation. The resulting quaternary ammonium salt of the coal was placed in a vacuum over and heated to a temperature of between 125° to 200° C. The reaction was rapid and the oven was cooled for several hours.

EXAMPLE 6

The procedure of Example 5 above was repeated except 50 grams of Rawhide subbituminous coal was used instead of Illinois No. 6 bituminous coal was treated.

Infrared analysis of the treated coal of both Examples 5 and 6 above revealed (1) that the hydroxyl stretching peak (3300–3600 $cm^{-1}$) was not present, and (2) there was a substantial increase in the C—H signal (2800–3000 $cm^{-1}$) relative to each starting coal before treatment. This analysis evidences that acidic hydrogens were replaced with butyl groups.

Any of the treated coal liquids and bottoms, as well as liquids derived from the treated coal of the above examples, will be found to be more stable and more compatible with petroleum liquids when compared to the same liquids and bottoms untreated.

What is claimed is:

1. A method for improving the properties of carbonous materials and products therefrom, said materials having acidic functionalities and having a pka of less than or equal to 22, wherein the method comprises:

(a) treating the carbonous material with at least one quaternary base; and (b) heating the treated carbonous material to a temperature of from 100° C. to about 300° C.

wherein the quaternary base is represented by the formula:

$$R_3R'MOR''$$

where each R is the same or different group selected from the $C_1$ to about $C_{20}$ alkyl, aryl, acyl, arylalkyl, alkylaryl, ether and ester groups, sulfide, amine as well as silicon, selenium or a metal selected from Groups I and II of the Periodic Table of the Elements; R′ is a $C_1$ to $C_4$ alkyl group; M is selected from Group VA of the Periodic Table of the Elements; and R″ is hydrogen, or a $C_1$ to about $C_{20}$ alkyl, aryl, arylalkyl or alkylaryl group.

2. The method of claim 1 wherein the carbonous material is selected from the group consisting of coal, oil shale, peat, heavy oils boiling over about 540° C., and vacuum and gas oil petroleum residuals.

3. The method of claim 1 wherein the carbonous material is selected from the group consisting of coal and oil shale.

4. The method of claim 1 wherein the carbonous material is coal or products therefrom.

5. The method of claim 1 wherein each R is the same or different $C_1$ to $C_6$ alkyl or aryl group.

6. The method of claim 4 wherein each R is the same or different $C_1$ to $C_4$ alkyl group.

7. The method of claim 1 wherein R″ is hydrogen or a $C_1$ to $C_4$ alkyl group.

8. The method of claim 6 wherein R″ is hydrogen.

9. The method of claim 1 wherein R′ is methyl.

10. The method of claim 8 wherein R′ is methyl.

11. The method of claim 1 wherein the carbonous material is treated with the quaternary base at a temperature from about 150° C. to about 250° C.

12. The method of claim 10 wherein the coal is treated with the quaternary base at a temperature from about 150° C. to about 250° C.

13. The method of claim 1 wherein a stoichiometric amount of quaternary base is employed based on the total number of acidic functionalities on the carbonous material.

14. The method of claim 12 wherein a stoichiometric amount of quaternary base is employed based on the total number of acidic functionalities on the coal.

15. The method of claim 14 wherein the quaternary base is a quaternary ammonium base or a quaternary phosphonium base, or mixtures thereof.

16. The method of claim 15 wherein the quaternary base is selected from the group consisting of tetramethylammonium hydroxide and methoxide, tetraethylammonium hydroxide and methoxide, tetrapropylammonium hydroxide and methoxide, tetrabutylammonium hydroxide and methoxide, tetrapentylammonium hydroxide and methoxide, tetrahexylammonium hydroxide and methoxide, benzylhexadecyldimethyl ammonium hydroxide and methoxide.

17. The method of claim 1 wherein the quaternary base is regenerated and recycled from the trisubstituted Group VA compound formed as a by-product of the instantly claimed method.

18. The method of claim 16 wherein the quaternary base is regenerated and recycled from the trisubstituted Group VA compound formed as a by-product of the instantly claimed method.

19. The method of claim 4 wherein the carbonous material is a coal liquid.

20. The method of claim 16 wherein the carbonous material is a coal liquid.

21. The method of claim 4 wherein the carbonous material is coal bottoms.

22. The method of claim 16 wherein the carbonous material is coal bottoms.

23. The method of claim 1 wherein the carbonous material is coal and the treated coal is subjected to liquefaction conditions.

24. The method of claim 16 wherein the treated coal is subjected to liquefaction conditions.

* * * * *